US007182304B2

(12) United States Patent
Adams

(10) Patent No.: US 7,182,304 B2
(45) Date of Patent: Feb. 27, 2007

(54) MANTEL HOOK

(75) Inventor: William E. Adams, Harmony, PA (US)

(73) Assignee: Adams Mfg. Corp., Porterville, PA (US)

( * ) Notice: Subject to any disclaimer, the term of this patent is extended or adjusted under 35 U.S.C. 154(b) by 0 days.

(21) Appl. No.: 10/967,828

(22) Filed: Oct. 18, 2004

(65) Prior Publication Data

US 2005/0082454 A1 Apr. 21, 2005

Related U.S. Application Data

(60) Provisional application No. 60/511,856, filed on Oct. 17, 2003.

(51) Int. Cl.
*F16B 45/00* (2006.01)

(52) U.S. Cl. ..... 248/304; 248/205.5; 248/227.2; 248/914

(58) Field of Classification Search ..... 248/303, 248/304, 339, 227.2, 317, 914, 205.5
See application file for complete search history.

(56) References Cited

U.S. PATENT DOCUMENTS

| | | | | | |
|---|---|---|---|---|---|
| 1,165,052 | A * | 12/1915 | Williams et al. | ..... | 248/615 |
| 2,473,086 | A * | 6/1949 | Montero | ..... | 248/308 |
| 2,532,255 | A * | 11/1950 | Davis | ..... | 248/215 |
| 2,565,719 | A | 8/1951 | Church | | |
| 2,631,803 | A | 3/1953 | Meyers | | |
| 2,754,974 | A * | 7/1956 | Larson | ..... | 211/70.6 |
| 3,321,166 | A * | 5/1967 | Gordon | ..... | 248/205.5 |
| 3,630,475 | A | 12/1971 | Barry | | |
| 4,082,241 | A * | 4/1978 | Burkey | ..... | 248/317 |
| 5,094,417 | A | 3/1992 | Creed | | |
| 5,422,803 | A * | 6/1995 | Kilgore | ..... | 362/392 |
| D360,572 | S | 7/1995 | Adams | | |
| 5,433,413 | A * | 7/1995 | Adams | ..... | 248/205.3 |
| 6,182,993 | B1 | 2/2001 | Rapp | | |
| 6,530,548 | B2 * | 3/2003 | Pizzirusso | ..... | 248/304 |
| 2004/0118989 | A1 * | 6/2004 | Sidelman | ..... | 248/339 |
| 2004/0195484 | A1 * | 10/2004 | Sheeran | ..... | 248/304 |

FOREIGN PATENT DOCUMENTS

GB 2380762 A * 4/2003

* cited by examiner

*Primary Examiner*—Korie Chan
(74) *Attorney, Agent, or Firm*—Buchanan Ingersoll & Rooney PC

(57) ABSTRACT

A hook for holding objects under a shelf or mantel has a body configured so that when the hook is positioned for holding an object under a shelf or mantel, a mounting end will be adjacent the top surface of the shelf and the opposite end will be under the bottom surface of the shelf. A resilient gripper body is attached to the mounting end of the hook body. The gripper body has a curved surface which is positioned for engagement with the top surface of the shelf. When the hook is placed on the top surface and no load is on the hook, a first portion of the curved surfaced will be on the top surface of the shelf and a second portion of the curved surface will be spaced away from the top surface of the shelf. As increasing loads are placed on the hook, the shape of the curved surface will change increasing the contact area between the gripper body and the top surface of the shelf.

12 Claims, 5 Drawing Sheets

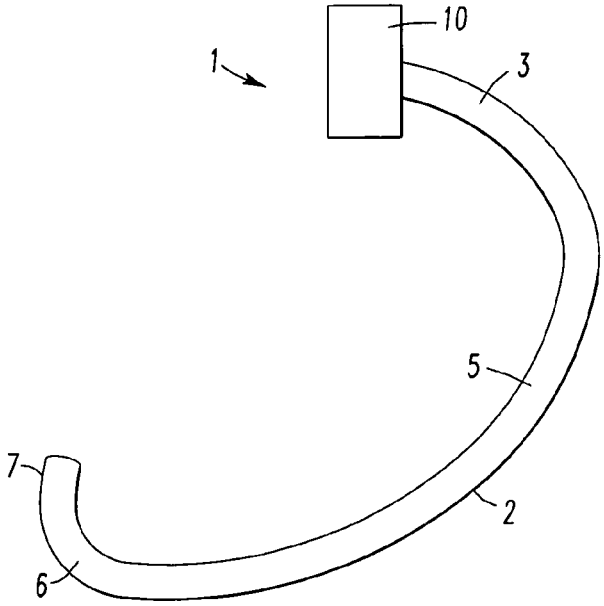
FIG. 1
FIG. 2
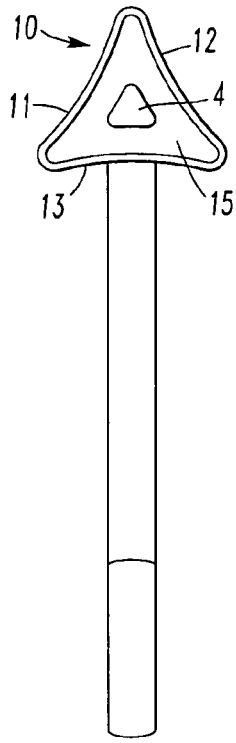
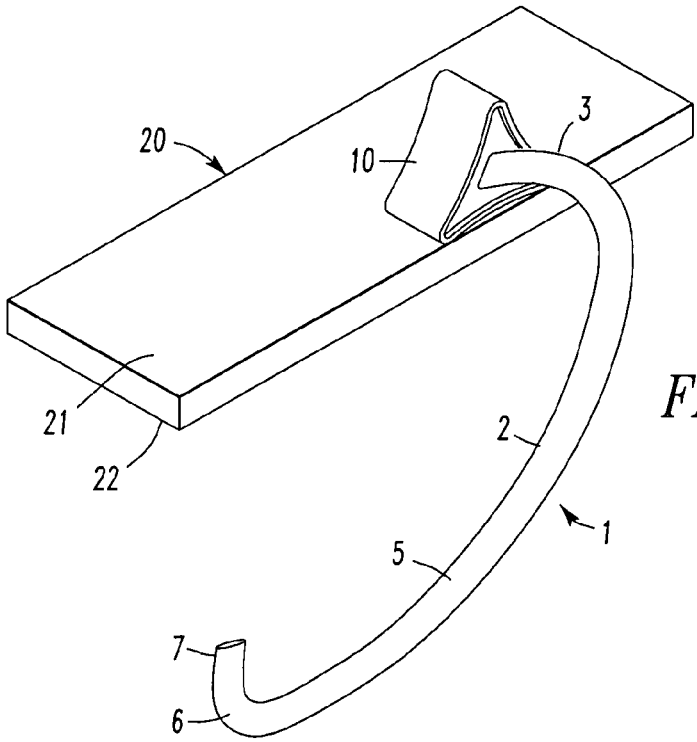
FIG. 3

FIG. 10
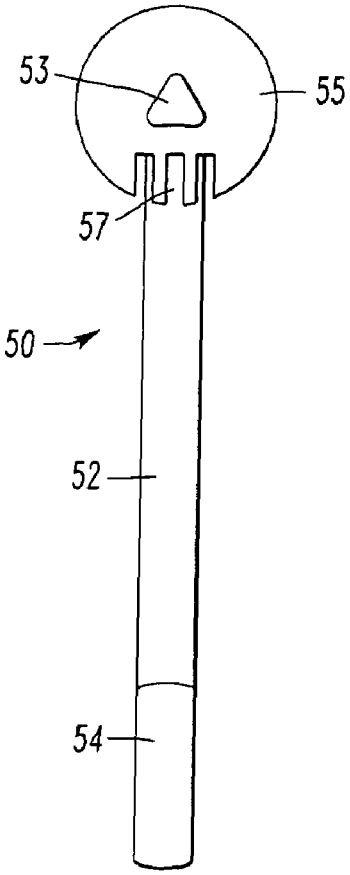
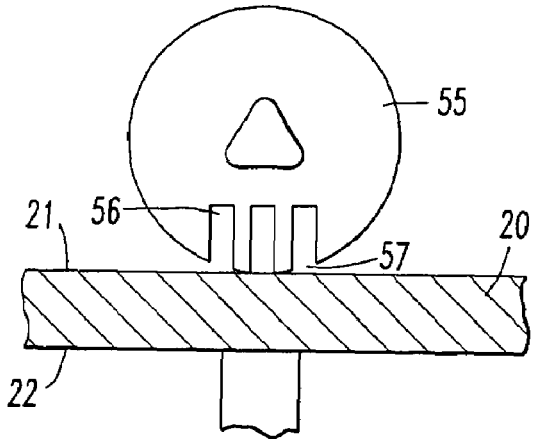
FIG. 11
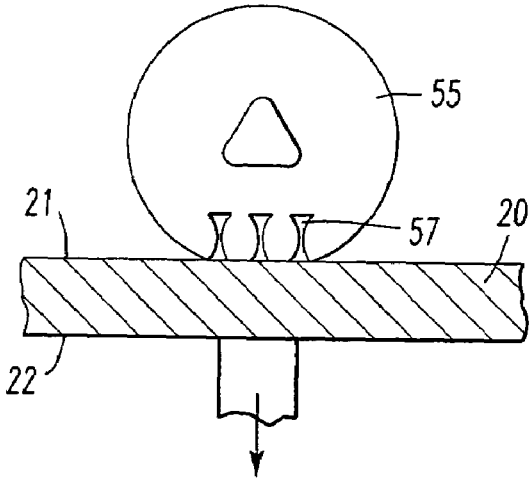
FIG. 12

MANTEL HOOK

CROSS REFERENCE TO RELATED APPLICATION

This application claims the benefit of U.S. Provisional Application Ser. No. 60/511,856, filed Oct. 17, 2003, the content of which is incorporated herein by reference.

FIELD OF THE INVENTION

The invention relates to hooks which sit on the top surface of a shelf and hold an object below the shelf.

BACKGROUND OF THE INVENTION

There are a variety of hooks which have been proposed for holding objects below a shelf or mantel. These hooks generally have a C-shape or an S-shape with the top of the hook having a flat surface which rests on the top surface of the shelf. Examples of this type of hook are disclosed in U.S. Pat. No. 5,094,417 to Creed; U.S. Pat. No. 3,630,475 to Barry, U.S. Pat. No. 2,565,719 to Church and my U.S. Design Patent Des. 360,572. Creed discloses that a length of anti-skid material such as rubber or the like may be fixed to the underside of the portion of the hook which rests on the top surface of the shelf. The product disclosed in my patent Des. 360,572 has been sold with double sided tape on the surface that rests on the shelf. In all of these prior art patents the surface of the hook which rests on the top surface of the shelf is flat. Thus, the contact area between the hook and the shelf is constant for all loads carried by the hook. In the event that a force is applied to the hook in a direction parallel to the length rather than width of the self, the hooks disclosed in these prior art patents will rock on the top surface of the shelf, lessening the contact area and making it easier for the hook to dislodge.

There are other hooks disclosed in the prior art which provide a bumper or cushion member between the hook and the surface against which the hook rests. U.S. Pat. No. 2,500,881 discloses a hook having an inverted U-shaped portion that fits over a car window. A tubular flexible bumper is positioned at the base of the U-shaped portion and rests on the top edge of the window. The bumper is used to prevent marring and chipping of the window. This hook also has a suction cup that attaches to the face of the window preventing movement of the hook. Because the suction cup prevents movement of the hook and the bumper is captured within the U-shaped portion, the bumper cannot deform to change the contact area between the bumper and the edge of the window when a load is placed on the hook. U.S. Pat. No. 6,182,933 discloses another hook having a U-shaped portion that fits over shingles or straight portion that fits between shingles. This hook has flexible, parallel fins that deform when the hook is installed by bending into a frictionally engaging relationship with a surface. The contact area between the fins and hook body and the adjacent surface does not continue to increase as the load on the hook increases. Hooks having a U-shaped portion are not used on mantels, which tend to be thicker than most shelves. The hook with a straight portion will not hold a load when placed on a shelf. U.S. Pat. No. 2,631,803 discloses a hook for suspending articles from the edge of a table or counter which consists of an L-shaped bar having a rubber cushion member on the end of the hook that rests on the top surface of the table or counter. The shape of the rubber cushion and the hook are such that the cushion is more likely to move rather than deform, as load changes or forces act on the side of the hook. Hooks having an inverted L-shaped body like the one disclosed in U.S. Pat. No. 2,631,803 are more easily dislodged than hooks which extend below the shelf and hold the object underneath the bottom surface of the shelf.

There is a need for a mantel hook which can securely hold objects below the mantel or the shelf and provide a greater gripping surface as the load on the hook increases. There is also a need for a mantel hook which will not rock on the shelf or become dislodged when subjected to forces against the side of the hook.

SUMMARY OF THE INVENTION

I provide a hook for holding objects under a shelf or mantel which has an elongated body having an mounting end and a supporting end. The body is configured so that when the hook is positioned for holding an object under a shelf or mantel, the mounting end will be on the top surface of the shelf and the supporting end will be under the bottom surface of the shelf. A resilient gripper body is attached to the mounting end of the hook body. The gripper body has a curved surface which is positioned for engagement with the top surface of the shelf. When the hook is placed on the top surface and no load is on the supporting end of the hook, a first portion of the curved surfaced will be on the top surface of the shelf and a second portion of the curved surface will be spaced away from the top surface of the shelf. As increasing loads are placed on supporting ends of the hook, the shape of the curved surface will change increasing the contact area between the gripper body and the top surface of the shelf. The increased contact will increase the friction between the gripper body and the shelf preventing movement of the gripper body across the shelf.

I prefer to provide a hook having an elongated body with a triangular or other polygon shaped cross section. I further prefer to provide a resilient gripper body having a generally triangular shape with curved sides. The mounting end of the elongated body is placed within a hole in the center of the gripper body. Since the entire gripper body is made of a flexible material, preferably polyvinyl chloride, the end of the elongated body can rotate when a force is applied against the side of the hook. Consequently, the hook will not rock on the surface of the shelf and the contact area between the gripper body and the shelf will not change.

In an alternative embodiment the gripper body has an air filled chamber between the mounting end of the hook and the curved surface of the gripper body which rests on the top surface of the shelf. As increasing loads are placed on the supporting end of the hook, the air compresses, or is released from the chamber, allowing the curved surface to flatten increasing the contact area between the top shelf and the gripper body.

In a third present embodiment the gripper body is spherical and has a series of slots. As the load on the hook increases the portions of the ball between the slots compress filling the slots and increasing the surface contact area of the gripper body on the shelf.

Yet another embodiment has a plurality of fins on the gripper body which engage the top surface of the shelf or mantel. As the load increases on the hook, the fins flex providing increased contact area between the gripper body and the surface.

Other objects and advantages of the present invention will become apparent from a description of certain present preferred embodiments shown in the drawings.

BRIEF DESCRIPTION OF THE FIGURES

FIG. 1 is a side view of a first present preferred embodiment for my mantel hook which can hold an object under a shelf.

FIG. 2 is a rear view of the embodiment shown in FIG. 1.

FIG. 3 is a perspective view of the hook shown in FIG. 1 placed on a shelf.

FIG. 10 is a rear view similar to FIG. 2 of a third present preferred embodiment of my mantel hook.

FIG. 11 is a rear view similar to FIG. 4 showing the mounting end of the embodiment of FIG. 10 on the top surface of a shelf with no load on the hook.

FIG. 12 is a rear view similar to FIG. 5 showing the mounting end of the embodiment of FIG. 10 when a load is applied to the hook.

DESCRIPTION OF THE PREFERRED EMBODIMENTS

Figure 4:
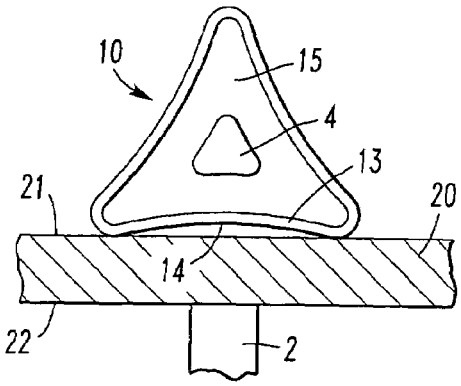
FIG. 4 is a rear view of the mounting end of the hook of FIG. 1 placed on a shelf with no load on the supporting end of the hook.
Figure 5:
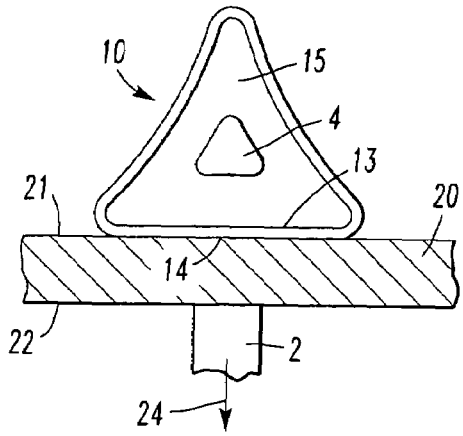
FIG. 5 is a rear view similar to FIG. 4 with an arrow indicating that a load is on the supporting end of the hook.

A first present preferred embodiment of my hook 1 for holding objects under a shelf or mantel, shown in FIGS. 1, 2 and 3, has an elongated body 2 with a mounting end 3 and a supporting end 6. A hook 7 is formed on the supporting end. A gripper body 10 is attached to the mounting end 3. A curved intermediate portion 5 extends from the mounting end 3 to the supporting end 6. Consequently, when the hook 1 is placed on a shelf 20, as shown in FIG. 3, the mounting end 3 will be positioned adjacent the top surface 21 of the shelf 20. The supporting end 6 will be under the bottom surface 22 of the shelf 20. The gripper body 10 is triangular having sides 11, 12 and 13. A web 15 is encircled by and attached to sides 11, 12 and 13. As seen most clearly in FIG. 4, side 13 of the gripper body 10 has a curved surface 14. When the hook is placed on the top surface 21 of shelf 20 and no load is applied to the hook, the gripper body will appear as shown in FIG. 4. A portion of the surface of side 13 near the corners of the gripper body will press against the top surface 21 of the shelf 20. A second portion of the curved surface between the two corners is above the top surface 21 of the shelf 20. When a weight is hung on the supporting end, a downward force as indicated by the arrow 24 in FIG. 5, side 13 of the gripper body 10 will deform, flattening curved surface 14. As the load is increased, curved surface 14 will flatten more and more, increasing the surface area of the side 13 which is in contact with the top surface 21 of shelf 20.

Figure 6:
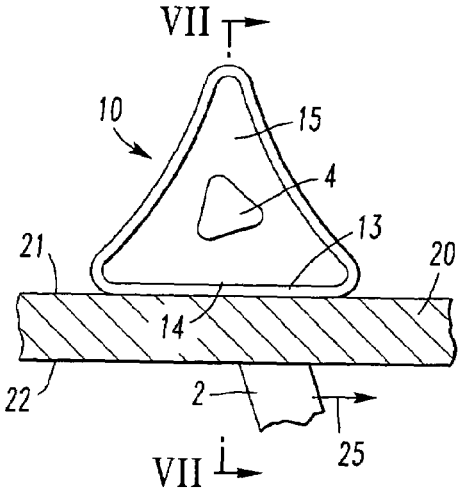
FIG. 6 is a rear view similar to FIGS. 4 and 5 showing the hook with a force acting against the side the hook as indicated by the arrow.
Figure 7:
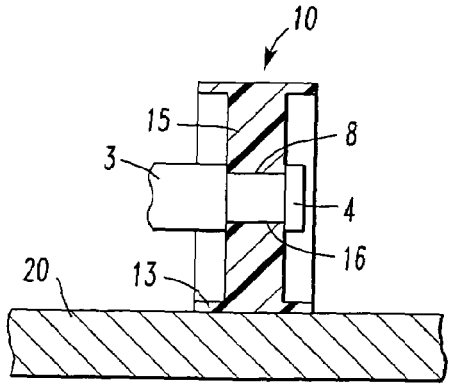
FIG. 7 is a sectional view taken the lines VII—VII of FIG. 6.
Figure 8:
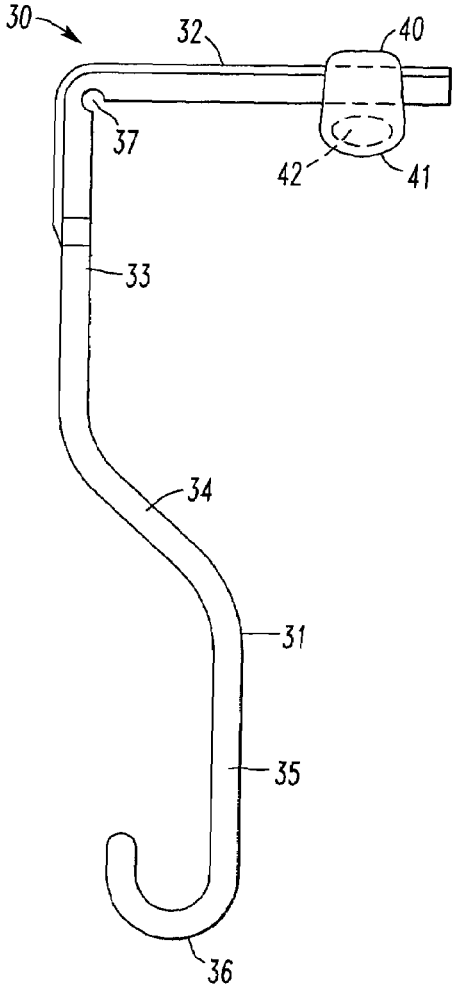
FIG. 8 is a side view of second present preferred embodiment of my mantel hook.
Figure 9:
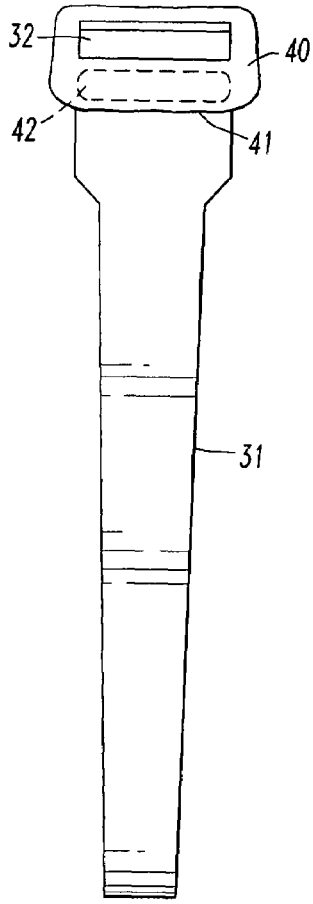
FIG. 9 is a rear view of the second preferred embodiment of FIG. 8.

The gripper body 20 is preferably molded of a soft plastic such as polyvinyl chloride. The Shore durometer of the plastic can be from 50 to 100 depending upon the size and shape of the gripper body. Sides 11, 12 and 13 have the same length, width and curvature. This makes assembly easier because any side 11, 12 or 13 could be positioned to rest on the top surface 21 of shelf 20. In a present preferred embodiment the length is 1 inch and the width is ½ inch. Web 15 preferably is about half as wide as the sides as shown in FIG. 7. The mounting end 3 of the hook has a circumferential groove 8. A hole 16 is cut in the center of web 15 to receive the mounting end 3 of the hook 1. As can be seen in FIGS. 6 and 7 the hole 16 is substantially parallel to the top surface 21 of the shelf. Hole 16 has the same cross section as the end 4 of the hook, but is slightly smaller in size. Because the web is a flexible material, the end of the hook can be inserted through hole 16 retaining the mounting end of the hook within the web 15 of the gripper body 10.

Referring to FIG. 6, when a force, indicated by arrow 25, acts on the side of the elongated body, the end 4 of the hook rotates up to about 45° flexing web 15. If the hook has a circular cross section or has a cross section with eight sides or more, the hook may rotate within hole 16 without flexing any portion of the web. Because the end of the hook can rotate within the gripper body, the force 25 does not cause the gripper body to rock on the top surface of the shelf. Instead, the contact area between the gripper body and the shelf remains the same.

A second present preferred embodiment 30 of my mantel hook utilizes the design of U.S. Patent Des. 360,572. The elongated body 31 has a mounting end 32 which is generally horizontal. Vertical portion 33 extends from the mounting end 32 to curved portion 34. A second vertical portion 35 connects hook 36 to the curved portion 34. Notch 37 is cut in the joint between the mounting end 32 and first vertical portion 33 to permit the hook to flex at that point. Attached to the mounting end 32 of the hook 30 is a gripper body 40. This body has a convex bottom surface 41 which rests on the top surface of a shelf. A air filled cavity 42 is provided within the body. If desired, a channel may be provided to allow air to be expelled from the chamber. When weight is placed on hook 36 the air in the cavity will compress or be expelled compressing the cavity 42. The compression of the air filled cavity increases the surface area of the curved bottom 41 which contact the top surface of the shelf.

A third embodiment of my mantel hook 50 shown in FIGS. 10, 11 and 12 has an elongated body 52 similar to body 2 of the first embodiment with a mounting end 53 and a supporting end 54. The gripper body 55 is a spherical ball having a series of slots 56. The slots may be parallel or intersect. When a load is placed on the supporting end of the hook the portions 57, 58 of the gripper body adjacent the slots compress and expand outward as shown in FIG. 12. This expansion closes the slots and increases the contact area between the gripper body and the top surface 21 of the shelf 20 on which the hook is mounted.

Figure 13:
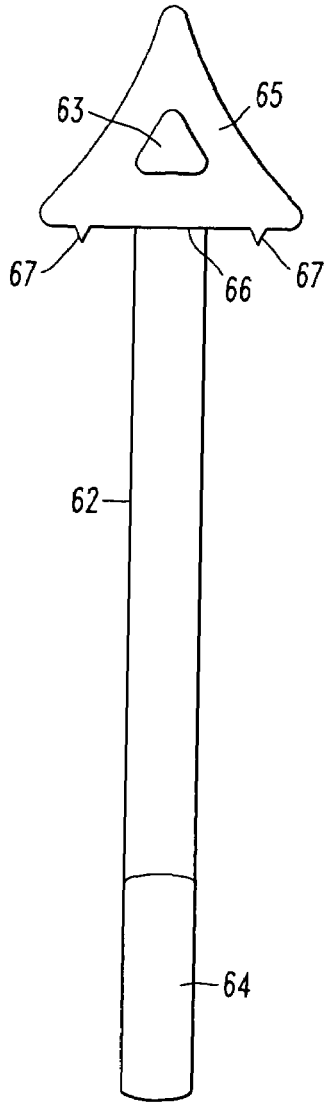
FIG. 13 is a rear view similar to FIG. 10 of a fourth present preferred embodiment of my mantel hook.
Figure 14:
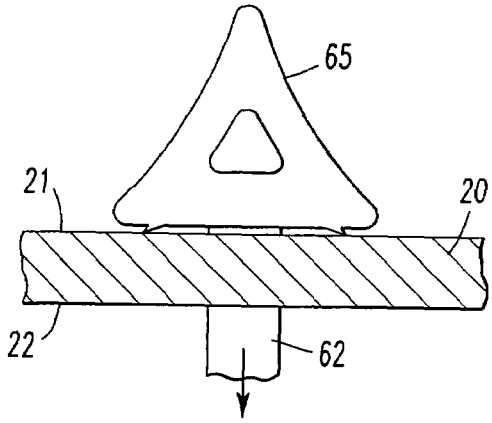
FIG. 14 us a rear view similar to FIG. 5 showing the mounting end of the embodiment of FIG. 13 on a shelf when a load is applied to the hook

A fourth embodiment of the mantel hook 60 shown in FIGS. 13 and 14 has a gripper body 65 in which a curved surface 66 includes a pair of projections 67. As in the previous embodiments this hook 60 has an elongated body 62 similar to the body 2 of the first embodiment with a mounting end 63 and a supporting end 64. When a load is placed on the supporting end, the projections flex outward as shown in FIG. 14. This movement increases the surface area of the gripper body that is in contact with the top surface 21 of the shelf 20 on which the mantel hook 60 is placed.

I tested the embodiment of the mantel hook in FIGS. 1 through 4 to determine how much weight the mantel hook would hold. The hook held ten pounds.

A significant advantage of the present mantel hook is that it will hold a Christmas stocking weighing up to ten pounds without slipping from the mantel when the stocking is swung from side to side or back and forth.

The elongated hook body in all the embodiments here disclosed is rigid. I prefer to mold the body of polycarbonate However, other plastics, metal or wood could be used.

While I have disclosed and described certain present preferred embodiments of my mantel hook for holding an object under a shelf or mantel, it should be distinctly understood that the invention is not limited thereto, but may be variously embodied within the scope of the following claims.

I claim:

1. A hook for holding an object under a shelf, the hook comprising:

a rigid elongated body having a mounting end and a supporting end, the body configured so that when the hook is positioned for holding an object under a shelf having a top surface and a bottom surface, the mounting end will be adjacent the top surface of the shelf and the supporting end will be under the bottom surface of the shelf and a resilient gripper body having a bore through which to the mounting end of the elongated body passes, the gripper body having a curved planar surface which is positioned for engagement with the top surface of the shelf, such that when the hook is placed on the top surface and no load is on the supporting end of the hook body the bore will be substantially parallel to the top surface, a first portion of the curved planar surface having a first area will be on the top surface of the shelf and a second portion of the curved planar surface having a second area will be spaced away from the top surface of the shelf and such that as increasing loads are placed on the supporting end of the hook, the shape of the curved planar surface will change with the first surface area increasing and the second surface area decreasing.

2. The hook of claim 1 wherein the elongated body has a curved intermediate portion extending between the mounting end and the supporting end.

3. The hook of claim 1 wherein the gripper body is comprised of a plurality of sides connected to form a polygon, the curved planar surface being on one side, and a web attached to and extending from the sides.

4. The hook of claim 3 wherein the gripper body has three sides.

5. The hook of claim 3 wherein the sides have a width and the web has a thickness less than the width of the sides.

6. The hook of claim 1 wherein the mounting end is able to rotate within the bore.

7. The hook of claim 1 wherein the gripper body is polyvinyl chloride.

8. The hook of claim 1 wherein the elongated body is polycarbonate.

9. The hook of claim 1 wherein the gripper body has an air filled cavity positioned so that the cavity will compress when a selected load is placed on the supporting end of the hook.

10. The hook of claim 9 wherein the gripper body has a channel connected to the air filled cavity which enables air to escape from the cavity when a selected load is placed on the supporting end of the hook.

11. The hook of claim 1 wherein the gripper body has a plurality of projections and portions of the projections form portions of the curved surface.

12. The hook of claim 1 wherein the curved surface of the gripper body is comprised of a plurality of projections which flex as increasing loads are placed on the supporting end of the elongated body.

* * * * *

UNITED STATES PATENT AND TRADEMARK OFFICE

CERTIFICATE OF CORRECTION

PATENT NO. : 7,182,304 B2
APPLICATION NO. : 10/967828
DATED : February 27, 2007
INVENTOR(S) : William E. Adams It is certified that error appears in the above-identified patent and that said Letters Patent is hereby corrected as shown below:

Title Page,
At (56) References Cited, delete "6,182,993" and insert --6,182,933--.

Signed and Sealed this

Nineteenth Day of June, 2007

JON W. DUDAS
*Director of the United States Patent and Trademark Office*